US011485548B1

(12) United States Patent
Tapocik

(10) Patent No.: US 11,485,548 B1
(45) Date of Patent: Nov. 1, 2022

(54) MULTI-USE APPLICATOR AND METHODS FOR ITS USE

(71) Applicant: Innovative Product Brands, Inc., Highland, CA (US)

(72) Inventor: Bryan Tapocik, Highland, CA (US)

(73) Assignee: Innovative Product Brands, Inc., Highland, CA (US)

( * ) Notice: Subject to any disclaimer, the term of this patent is extended or adjusted under 35 U.S.C. 154(b) by 0 days.

(21) Appl. No.: 17/722,097

(22) Filed: Apr. 15, 2022

Related U.S. Application Data

(60) Provisional application No. 63/176,106, filed on Apr. 16, 2021.

(51) Int. Cl.
*B65D 35/28* (2006.01)
*A47K 5/00* (2006.01)

(52) U.S. Cl.
CPC ..... *B65D 35/28* (2013.01); *A47K 5/00* (2013.01)

(58) Field of Classification Search
CPC ..... B65D 35/28; B65D 35/56; B65D 35/565; B65D 51/249; B65D 51/24; B65D 83/0072; A47K 5/00
USPC ..... 248/108, 109; 222/103, 107, 182, 183; 401/152
See application file for complete search history.

(56) References Cited

U.S. PATENT DOCUMENTS 1,510,848 A * 10/1924 Hubbard ..... B65D 35/56 248/109
1,654,549 A * 1/1928 Mohun ..... B65D 35/28 248/108
1,692,116 A * 11/1928 Greist ..... B65D 35/28 248/108
1,793,787 A * 2/1931 Ertola ..... B65D 35/285 248/108
1,861,528 A * 6/1932 Hadden ..... B65D 35/28 248/108
2,053,697 A * 9/1936 Cassanos ..... B65D 35/28 222/103
2,600,553 A * 6/1952 Lord ..... B65D 35/34 222/105
2,763,401 A * 9/1956 Buras, Jr. ..... B65D 35/28 222/105
3,022,920 A * 2/1962 Croom, Jr. ..... B65D 35/24 222/105
3,211,341 A * 10/1965 Bailey ..... B65D 35/28 222/173
3,262,605 A * 7/1966 Madden ..... B65D 35/28 248/108
4,172,536 A * 10/1979 Holt ..... B65D 35/28 222/103

(Continued)

*Primary Examiner* — Terrell L McKinnon
*Assistant Examiner* — Michael McDuffie
(74) *Attorney, Agent, or Firm* — Minta Law Group LC; Veronica-Adele R. Cao

(57) ABSTRACT

A multi-use applicator and methods for dispensing compounds. The applicator is configured for use with a compressible tubular container. The applicator has a holding member, where the holding member incorporates a fastening mechanism to secure the compressible tubular container. Once the compressible tubular container is secured to the holding member, a cover may be placed over the container and connected to the holding member. The cover may include at least one compressible side which when pressed would facilitate the extraction of the materials out of the compressible tubular container.

31 Claims, 9 Drawing Sheets

(56) References Cited

U.S. PATENT DOCUMENTS

| | | | | | |
|---|---|---|---|---|---|
| 5,097,987 | A * | 3/1992 | Liberatore | B65D 35/32 | 248/108 |
| 5,167,348 | A * | 12/1992 | Okami | B65D 35/28 | 222/93 |
| 5,261,571 | A * | 11/1993 | Goncalves | G01F 11/08 | 222/541.6 |
| 5,553,819 | A * | 9/1996 | Smajdek | B65D 35/245 | 248/108 |
| 5,678,731 | A * | 10/1997 | Okamura | B65D 35/28 | 222/391 |
| 5,920,967 | A * | 7/1999 | Souza | B65D 35/28 | 222/103 |
| 6,968,978 | B1 * | 11/2005 | Matthews | B65D 35/28 | 222/103 |
| 10,912,427 | B1 * | 2/2021 | Szajnert | A61J 1/035 | |
| 2006/0255065 | A1 * | 11/2006 | Crosby | B65D 35/285 | 222/93 |
| 2007/0075092 | A1 * | 4/2007 | Allen | B65D 35/565 | 222/103 |
| 2012/0248145 | A1 * | 10/2012 | Kealy | B65D 35/28 | 222/103 |
| 2016/0167826 | A1 * | 6/2016 | Scott | B65D 1/0223 | 222/182 |

* cited by examiner

MULTI-USE APPLICATOR AND METHODS FOR ITS USE

CROSS-REFERENCE TO RELATED APPLICATION

This non-provisional application claims priority to U.S. Provisional Application No. 63/176,106, titled APPARATUS FOR DISPENSING COMPOUNDS, AND METHODS FOR ITS USE and filed on Apr. 16, 2021 in the name of the Applicant herein, the entirety of which is incorporated herein by reference.

FIELD OF THE INVENTION

The present invention relates generally to a dispenser apparatus. More specifically, the present invention is a handheld multi-use applicator configured for use with a compressible container that provides enhanced flow and pinpoint control for dispensing liquid or viscous fluid from the compressible container.

BACKGROUND OF THE INVENTION

Dispensing liquids and/or viscous fluids from a compressible container oftentimes is challenging. In one example, a toothpaste container having a closed end and a dispensing outlet may be compressed to dispel the toothpaste from an open end. The practice of extracting materials from these types of containers become difficult as less material resides in the container. Furthermore, controlling the flow of the material from the dispensing outlet becomes problematic as the remaining materials within the container become unevenly distributed. This may result in loss of material within the container that cannot be extracted.

Difficulty also arises because the compressible containers are short in length and are held and pressed between the thumb and forefinger, whereby precision dispensing is wholly contingent upon the individual firmly holding the compressible container between the fingers while compressing the container body. The present disclosure provides for a multi-use applicator for dispensing liquid or viscous fluid from a compressible container and methods for its use that address the above-identified concerns. Other benefits and advantages will become clear from the disclosure provided herein and those advantages provided are for illustration. The statements in this section merely provide the background related to the present disclosure and do not constitute prior art.

SUMMARY

In accordance with one or more embodiments of the present invention, an applicator for use with a compressible container is disclosed. The applicator comprises: a holding member comprising: a body; a neck extending from a proximal end of the body of the holding member; and a fastening mechanism extending from a proximal end of the neck of the holding member, the fastening mechanism being configured to removably couple to the compressible container. The applicator also comprises a cover removably coupled to the holding member, the cover comprising: a body defining a central channel therethrough; a compression area on the body of the cover; and at least two oppositely disposed protrusions formed on an interior surface of the body of the cover and positioned within the compression area.

In accordance with one or more embodiments of the present invention, a multi-use applicator is disclosed. The multi-use applicator comprises: a holding member comprising: a conical body; a cylindrical neck extending from a proximal end of the conical body of the holding member; and a fastening mechanism extending from a proximal end of the cylindrical neck of the holding member, the fastening mechanism comprising: a cylindrical base; at least two oppositely disposed prongs, each prong comprising: a distal end extending from the cylindrical base of the fastening mechanism; a body; and an inwardly curved proximal end; a U-shaped space formed between the at least two oppositely disposed prongs, wherein the U-shaped space is configured to receive and hold a crimped distal end of the compressible container; a space formed between the inwardly curved proximal ends of the at least two oppositely disposed prongs, wherein a width of the space between the inwardly curved proximal ends of the at least two oppositely disposed prongs is narrower than a width of the U-shaped space between the at least two oppositely disposed prongs; and two oppositely disposed tapered surfaces formed on a distal portion of the cylindrical base; a first annular shoulder formed between the cylindrical neck of the holding member and the conical body of the holding member; and a second annular shoulder formed between the cylindrical neck of the holding member and the cylindrical base of the fastening mechanism; wherein the first annular shoulder formed between the cylindrical neck of the holding member and the conical body of the holding member, the cylindrical neck, and the second annular shoulder formed between the cylindrical neck of the holding member and the cylindrical base of the fastening mechanism together form an annular groove. The multi-use applicator also comprises a cover removably coupled to the holding member, the cover comprising: a flexible body defining a central channel therethrough; a compression area on the flexible body of the cover, the compression area formed by two oppositely disposed concave indentations formed on an outer surface of the flexible body of the cover; and at least two oppositely disposed protrusions formed on an interior surface of the flexible body of the cover and positioned within a distal portion of the compression area.

In accordance with one or more embodiments of the present invention, a multi-use applicator is disclosed. The multi-use applicator comprises a holding member comprising: a conical body; a cylindrical neck extending from a proximal end of the conical body of the holding member; and a fastening mechanism extending from a proximal end of the cylindrical neck of the holding member, the fastening mechanism comprising: a cylindrical base; a first pair of oppositely disposed prongs; a second pair of oppositely disposed prongs positioned parallel to the first pair of oppositely disposed prongs, wherein each prong of the first pair and second pair of prongs comprises: a distal end extending from the cylindrical base of the fastening mechanism; a body; and an inwardly curved proximal end; a V-shaped space formed between the first pair of oppositely disposed prongs and the second pair of oppositely disposed prongs; a first U-shaped slot formed between the two prongs of the first pair of oppositely disposed prongs; a second U-shaped slot formed between the two prongs of the second pair of oppositely disposed prongs and positioned directly in line with the first U-shaped slot, wherein the first U-shaped slot and the second U-shaped slot are configured to receive and hold a crimped distal end of the compressible container; a first space formed between the inwardly curved proximal ends of the two prongs of the first pair of oppositely disposed prongs; a second space formed between the inwardly curved proximal ends of the two prongs of the second pair of oppositely disposed prongs, wherein a width of the first space is equal to a width of the second space and wherein the width of the first space and the width of the second space are both narrower than a width of the first U-shaped slot and a width of the second U-shaped slot; and two oppositely disposed tapered surfaces formed on a distal portion of the cylindrical base; a first annular shoulder formed between the cylindrical neck of the holding member and the conical body of the holding member; and a second annular shoulder formed between the cylindrical neck of the holding member and the cylindrical base of the fastening mechanism, wherein the first annular shoulder formed between the cylindrical neck of the holding member and the conical body of the holding member, the cylindrical neck, and the second annular shoulder formed between the cylindrical neck of the holding member and the cylindrical base of the fastening mechanism together form an annular groove. The multi-use applicator also comprises a cover removably coupled to the holding member, the cover comprising: a flexible body defining a central channel therethrough; a compression area on the flexible body of the cover, the compression area formed by two oppositely disposed concave indentations formed on an outer surface of the flexible body of the cover; two oppositely disposed wedge-shaped protrusions formed on an interior surface of the flexible body of the cover and positioned within a distal portion of the compression area, wherein each of two protrusions traverses across a portion of the central channel of the cover creating a compression void between the two oppositely disposed protrusions; an interior annular flange formed on the interior surface of the flexible body of the cover and positioned at an open distal end of the flexible body of the cover, the interior annular flange configured to mate with the annular groove of the holding member; an annular shoulder formed at a proximal end of the flexible body of the cover, the annular shoulder being positioned perpendicularly to the outer surface of the flexible body of the cover and extending inwardly toward the central channel of the flexible body of the cover; an aperture defined by the annular shoulder of the flexible body of the cover, the aperture for receiving a dispensing outlet of the compressible container therethrough, wherein a diameter of the aperture is smaller than a diameter of the central channel of the flexible body of the cover; a first notch formed within the interior annular flange formed on the interior surface of the flexible body of the cover; and a second notch formed within the interior annular flange formed on the interior surface of the flexible body of the cover and positioned opposite from the first notch, wherein the first notch is configured to slidably mate with the first pair of oppositely disposed prongs of the fastening mechanism and wherein the second notch is configured to slidably mate with the second pair of oppositely disposed prongs of the fastening mechanism.

BRIEF DESCRIPTION OF THE DRAWINGS

The present application is further detailed with respect to the following drawings. These figures are not intended to limit the scope of the present application, but rather, illustrate certain attributes thereof.

DETAILED DESCRIPTION OF THE INVENTION

The description set forth below in connection with the appended drawings is intended as a description of presently preferred embodiments of the disclosure and is not intended to represent the only forms in which the present disclosure may be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that are also intended to be encompassed within the spirit and scope of this disclosure.

FIGS. 1-10 together disclose a multi-use applicator 10 for dispensing liquid or viscous fluid from a compressible container 1000. As used herein to describe the applicator 10, "multi-use" should be understood to mean that the applicator 10 of the present invention is multifunctional or general-purpose; i.e. it may be used to dispense material from a compressible container 1000 of any size and the material within the container 1000 may be of any type and used for any purpose. The materials may include, for example, teeth whitening compounds, dental bonding and filling compounds, adhesives such as glue, gels, creams, and virtually any substance that has a sufficient viscosity to be pushed through an applicator 10. The applicator 10 of the present invention is also reusable. Specifically, the compressible container 1000 within the applicator 10 may be removed and replaced by another compressible container 1000. The applicator 10 may then be reused with the new compressible container 1000.

This disclosure describes an applicator 10 for use with a compressible container 1000, where the compressible container 1000 may be shown or described as being tubular in shape; however, it should be clearly understood that the compressible container 1000 may be of any shape as long as the container 1000 is compressible. In its most simple form, the applicator 10 includes a holding member 12 and a cover 62 that is removably coupled to the holding member 12. The holding member 12 may comprise a fastening mechanism 34 that is configured to be removably coupled to the compressible container 1000 and to secure the compressible container 1000 within the applicator 10. Once the container 1000 is secured to the holding member 12 via its fastening mechanism 34, a cover 62 may be placed over the container 1000 and connected to the holding member 12. The cover 62 may include at least one compressible side which, when pressed, would facilitate the extraction of the materials out of the container 1000.

Figure 1:
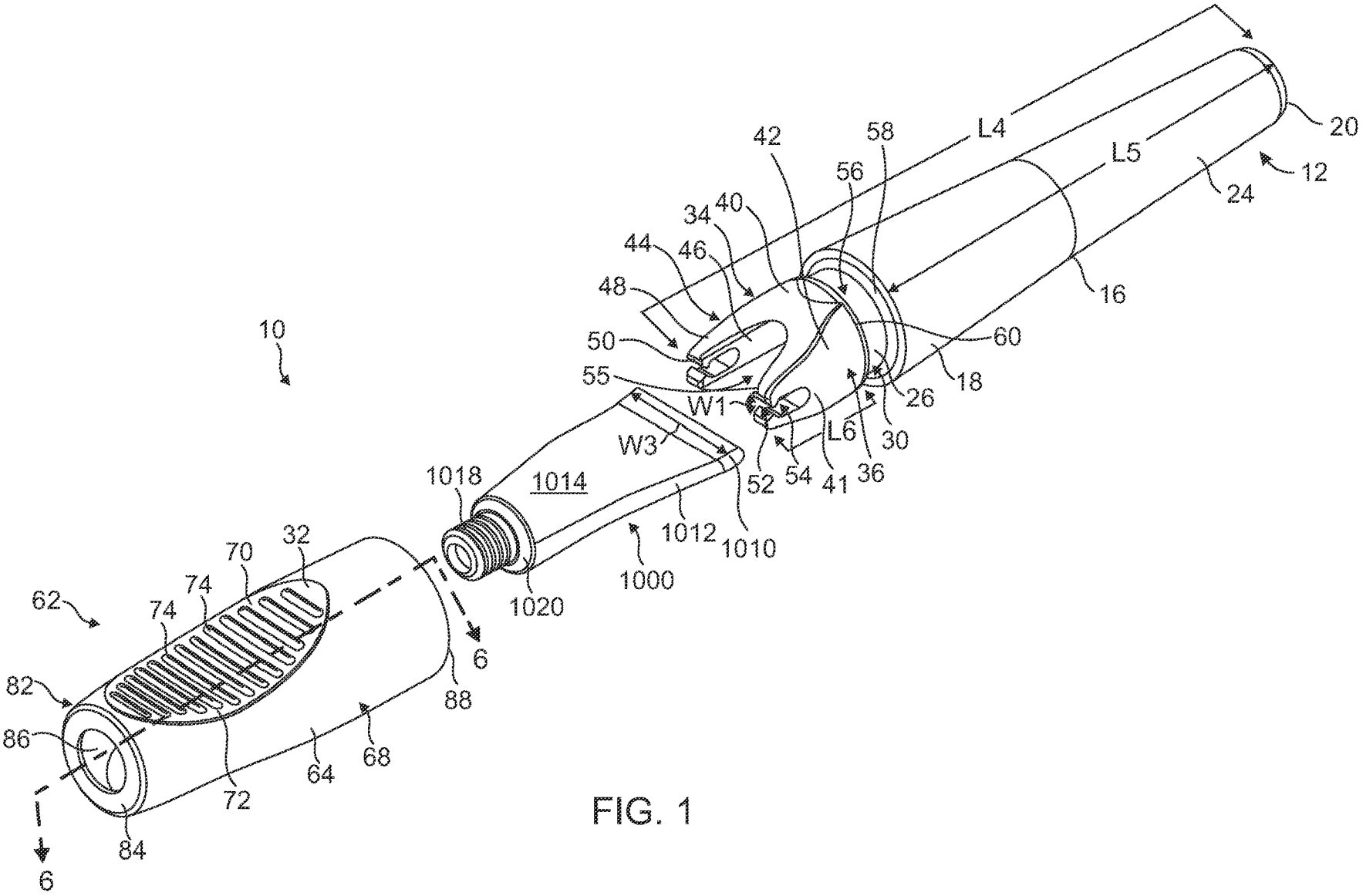
FIG. 1 is an exploded perspective view of a multi-use applicator in accordance with one or more aspects of the present invention, shown in an open unassembled position.

FIG. 1 is a perspective view of a multi-use applicator 10, in accordance with one or more aspects of the present invention. The applicator 10 is shown in an open position. In its simplest form, the applicator 10 has a holding member 12 and a cover 62. The holding member 12 may be removably coupled to the cover 62.

The holding member 12 may be made of rigid materials such as hard plastics or any other suitable material. The holding member 12 of the applicator 10 may have a body 16, a neck 26 coupled to and extending from a proximal end 18 of the body 16, and a fastening mechanism 34 coupled to and extending from a proximal end 30 of the neck 26. The body 16, the neck 26, and the fastening mechanism 34 are preferably integrally formed portions of the holding member 12. The body 16 of the holding member 12 may be solid in form or it may be hollow, defining a central channel 22 extending along its length. Where the body 16 of the holding member 12 defines a central channel 22, the central channel 22 may extend longitudinally through the entire length of the body 16, whereby the body 16 will have an open distal end 20. Alternatively, where the body 16 of the holding member 12 defines a central channel 22, the central channel 22 may extend longitudinally along a portion of the length of the body 16 and terminate at a closed distal end 20 of the body 16.

As shown in this embodiment, the body 16 may have a tapered conical shape wherein the external diameter of the cone-shaped body 16 at its proximal end 18 is greater than the external diameter of the cone-shaped body 16 at its distal end 20. Although the body 16 is described as having a conical shape, it should be clearly understood that substantial benefit may also be derived if the body 16 has a cuboid shape, a cylindrical shape, and hour-glass shape, or any other suitable shape. It should also be clearly understood that the body 16 may have a constant uniform external diameter throughout its entire length.

The body 16 of the holding member 12 may be used as a handle by a user of the applicator 10. A user may hold the body 16 of the holding member 12 at any location along its length. The body 16 of the holding member 12 may have a smooth outer surface 24. Alternatively, the holding member 12 may comprise at least one textured structure (e.g. rib, lettering, logo, graphic, etc.) formed on the outer surface 24 of the body 16 of the holding member 12. The textured structure(s) may be formed along an entire length of the outer surface 24 of the body 16 of the holding member 12. Or, the textured structure(s) may be formed along only a portion of the length of the outer surface 24 of the body 16. Where the textured structure(s) are formed along a portion of the length of the outer surface 24 of the body 16, the textured structure(s) may be located near the proximal end 18 of the body 16 of the holding member 12 or near any suitable portion of the body 16 of the holding member 12.

The neck 26 of the holding member 12 is coupled to and extends from a proximal end 18 of the body 16. The neck 26 of the holding member 12 may be solid in form or it may be hollow, defining a central channel 28 extending along its length. Where the neck 26 defines a central channel 28, the central channel 28 may extend longitudinally through the entire length of the neck 26, whereby the central channel 28 of the neck 26 of the holding member 12 will be contiguous with the central channel 22 defined by the body 16 of the holding member 12.

In this embodiment shown, the neck 26 of the holding member 12 is cylindrical in shape to coordinate with the conical shape of the body 16 of the holding member 12. The external diameter of the neck 26 is shown as being constant and uniform throughout its entire length. The external diameter of the neck 26 may be less than the external diameter of the proximal end 18 of the body 16, thereby creating an annular shoulder 58 between the neck 26 and the body 16 of the holding member 12. The annular shoulder 58 may be positioned perpendicularly relative to the outer surface 24 of the body 16 of the holding member 12. Alternatively, the annular shoulder 58 may have a beveled edge (not shown) and be positioned at an angle relative to the outer surface 24 of the body 16 of the holding member 12.

The fastening mechanism 34 is coupled to and extends from the proximal end 30 of the neck 26 of the holding member 12. In this embodiment, the fastening mechanism 34 has a base 36 and two pairs of prongs 44 wherein a V-shaped space 55 is formed between the two pairs of prongs 44. The base 36 of the fastening mechanism 34 may be solid in form or it may be hollow, defining a central channel 38 extending along its length. Where the base 36 of the fastening mechanism 34 defines a central channel 38, the central channel 38 may extend longitudinally through the entire length of the base 36, whereby the central channel 38 of the base 36 of the fastening mechanism 34 will be contiguous with the central channel 28 defined by the neck 26 of the holding member 12 and also contiguous with the central channel 22 defined by the body 16 of the holding member 12. The central channel 38 of the base 36 of the fastening mechanism 34, the central channel 28 of the neck 26, and the central channel 22 of the body 16 would therefore together form the central channel 14 of the entire holding member 12 which extends through the base 36 of the fastening mechanism 34, the neck 26, and the body 16 of the holding member 12. As described above, the central channel 14 of the entire holding member 12 may extend through an open distal end 20 of the body 16 of the holding member 12 or the central channel 14 of the entire holding member 12 may terminate at a closed distal end 20 of the body 16 of the holding member 12.

The base 36 of the fastening mechanism 34 may be cylindrical in shape to coordinate with the cylindrical shape of the neck 26 and the conical shape of the body 16. The external diameter of the base 36 of the fastening mechanism 34 is shown as greater than the external diameter of the neck 26, thereby creating an annular shoulder 60 between the neck 26 and the base 36 of the fastening mechanism 34. The annular shoulder 60 between the neck 26 and the base 36 may have a beveled edge and be positioned at an angle relative to the neck 26. Alternatively, the annular shoulder 60 may be positioned perpendicularly (not shown) relative to the neck 26. As also shown in this embodiment, the base 36 may have two oppositely disposed tapered surfaces 40 formed thereon. The two oppositely disposed tapered surfaces 40 may be positioned on a distal portion of the base 36 and adjacent to the annular shoulder 60 between the neck 26 of the holding member 12 and the base 36 of the fastening mechanism 34. In one embodiment, the external diameter of the base 36, when taken at the oppositely disposed tapered surfaces 40, may be smaller than the external diameter of the base 36 at the non-tapered surfaces 41. Thus, the external diameter of the base 36 at the tapered surfaces 40 would equal to the external diameter of the neck 26. In another embodiment, the external diameter of the base 36, when taken at the oppositely disposed tapered surfaces 40, may be equal to the external diameter of the base 36 at the non-tapered surfaces 41. Thus, the external diameter of the base 36 at the tapered surfaces 40 would still be greater than the external diameter of the neck 26.

The annular shoulder 60 between the base 36 of the fastening mechanism 34 and the neck 26, the neck 26, and the annular shoulder 58 between the neck 26 and the body 16 of the holding member 12 together form a connection point 56 for the cover 62 of the multi-use applicator 10. The connection point 56 is an annular groove configured to mate with an interior annular flange 90 formed at a distal end 88 of the cover 62, such that the distal end 88 of the cover 62 may encapsulate the connection point 56 when the applicator 10 is assembled (described in more detail below). Through this connection point 56, the cover 62 may be held into place while the cover 62 is squeezed to extrude materials from the compressible container 1000 within. When the applicator 10 is assembled and the interior annular flange 90 of the distal end 88 of the cover 62 mates with the connection point 56 (i.e. annular groove), the interior annular flange 90 will be flush with the annular shoulder 58 between the neck 26 and the body 16 of the holding member 12, thus causing the external diameter of the outer surface 68 at the distal end 88 of the cover 62 to be equal to the external diameter of the outer surface 24 of the proximal end 18 of the of the body 16 of the holding member 12.

Figure 2:
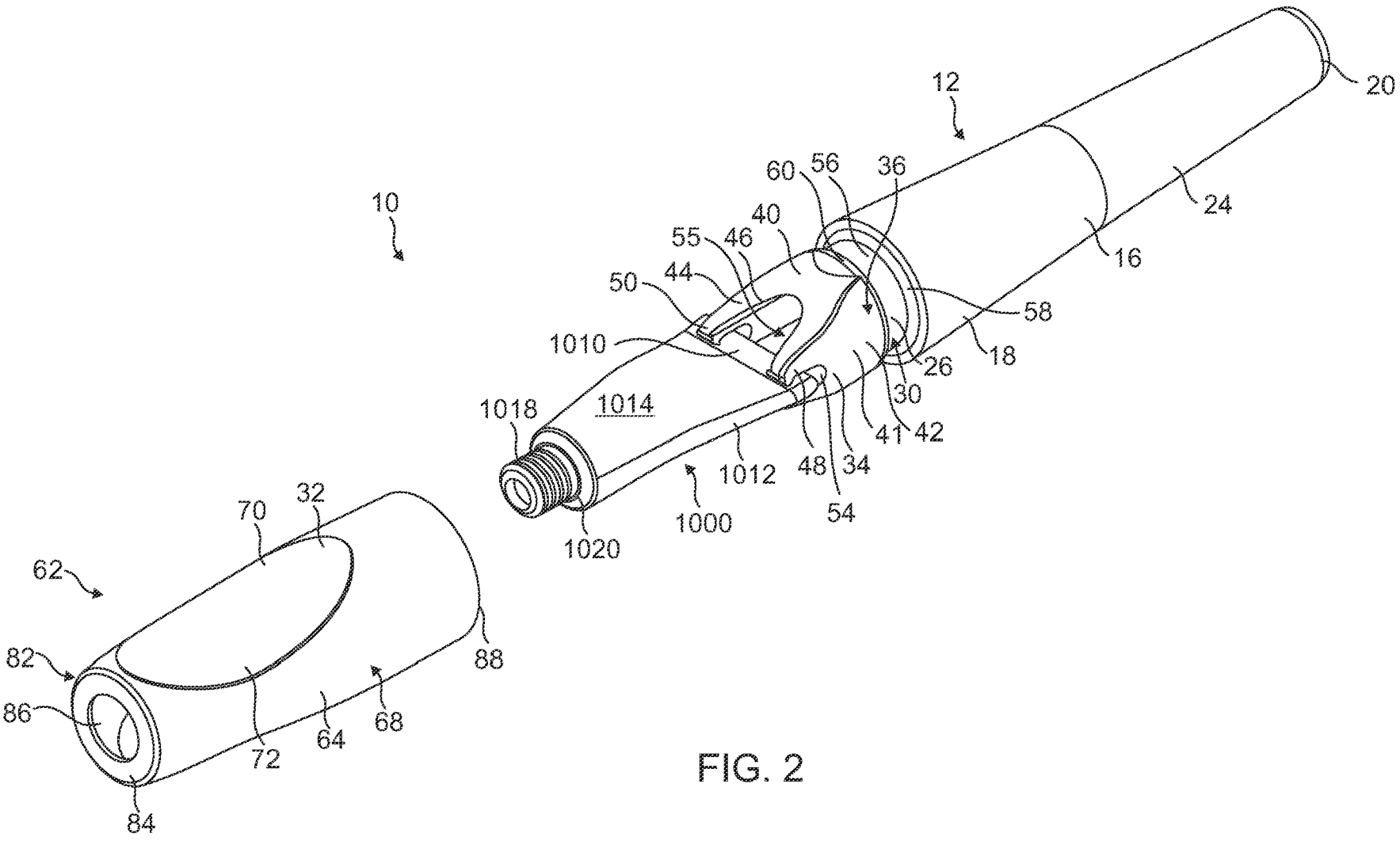
FIG. 2 is a perspective view of the multi-use applicator of FIG. 1, shown in use with a compressible container secured within the prongs of the fastening mechanism of the holding member.

Referring to FIG. 2, the fastening mechanism 34 of the holding member 12 may hold the compressible container 1000 into place. The fastening mechanism 34 may comprise one or more pairs of prongs 44 to hold the crimped distal end 1010 of the compressible container 1000. In this embodiment, the fastening mechanism 34 is shown as having two pairs of prongs 44. A first pair of prongs 44 may hold one side of the crimped distal end 1010 of the compressible container 1000 and a second pair of prongs 44 may hold an opposite side of the crimped distal end 1010 of the compressible container 1000. Although the fastening mechanism 34 is shown as having two pairs of prongs 44 to secure the container 1000 into place, it should be clearly understood that substantial benefit may be derived from the fastening mechanism 34 having a single pair of prongs 44 (see FIG. 3) or more than two pairs of prongs 44 (not shown).

Each prong 44 has a distal end 46 that is coupled to and extends from the proximal end 42 of the base 36 of the fastening mechanism 34, has a body 48, and has an inwardly curved proximal end 50. In this embodiment, the prongs 44 are formed in pairs, each pair of prongs 44 comprising a first prong 44 positioned opposite from a corresponding second prong 44. Each pair of prongs 44 defines a U-shaped slot 54 (generically referred to as a "U-shaped space") between the body 48 of the first prong 44 and the body 48 of the second prong 44. The first pair of prongs 44 is positioned parallel to the second pair of prongs 44 so that the U-shaped slot 54 between the first pair of prongs 44 is directly in line with the U-shaped slot 54 between the second pair of prongs 44. Each pair of prongs 44 also defines a space 52 between the inwardly curved proximal end 50 of the first prong 44 and the inwardly curved proximal end 50 of the second prong 44. As shown, the width W1 of the space 52 between the inwardly curved proximal end 50 of the first prong 44 and the inwardly curved proximal end 50 of the second prong 44 is narrower than the width W2 of the U-shaped slot 54 between the first prong 44 and the second prong 44. With this configuration, the crimped distal end 1010 of the compressible container 1000 may be received and held within the U-shaped slot 54 between the body 48 of the first prong 44 and the body 48 of the second prong 44. Furthermore, the inwardly curved proximal ends 50 of the first and second prongs 44 together would form a tight fit about the crimped distal end 1010 of the compressible container 1000 to prevent it from sliding out of the U-shaped slot 54.

In construction, the width W2 of the U-shaped slot 54 between the first prong 44 and the second prong 44 of the fastening mechanism 34 may vary depending upon the size of the compressible container 1000 that will be used with the multi-use applicator 10. For example, the width W2 of the U-shaped slot 54 may be within the range of approximately 2.5 mm for smaller compressible containers 1000 to approximately 4.5 mm for larger compressible containers 1000. Although this range is provided as an example, it should be clearly understood that substantial benefit may still be derived from a width W2 that is smaller than 2.5 mm or larger than 4.5 mm, as long as the width W2 of the U-shaped slot 54 is sized to accommodate the size of the compressible container 1000 intended to be used with the applicator 10. The U-shaped slot 54 may also have a length L1 of approximately 4 mm, when taken along the straight portions of the U-shaped slot 54. Although 4 mm is an example of the length L1 of the U-shaped slot 54, it should be clearly understood that substantial benefit may be derived from a length L1 longer or shorter than 4 mm, as long as the U-shaped slot 54 is long enough to accommodate the size of the compressible container 1000. Similarly, the width W1 of the space 52 between the inwardly curved proximal end 50 of the first prong 44 and the inwardly curved proximal end 50 of the second prong 44 may also vary depending upon the size of the compressible container 1000 that will be used with the multi-use applicator 10.

The external diameter of the base 36 of the fastening mechanism 34 may be sized to accommodate compressible containers 1000 of varying sizes. For example, a fastening mechanism 34 may have a base 36 with an external diameter of approximately 15.1 mm. A base 36 with an external diameter of approximately 15.1 mm would be suitable to couple to the crimped distal end 1010 of a compressible container 1000 wherein the crimped distal end 1010 had a width W3 within the range of approximately 8.7 mm to approximately 15 mm. Although this range is provided as an example, it should be clearly understood that substantial benefit may still be derived from a fastening mechanism 34 having a base 36 with an external diameter that is smaller than approximately 15.1 mm to accommodate a compressible container 1000 with a crimped distal end 1010 having a smaller width W3 than 8.7 mm. And it should be further understood that substantial benefit may still be derived from a fastening mechanism 34 having a base 36 with a diameter that is larger than approximately 15.1 mm to accommodate a compressible container 1000 with a crimped distal end 1010 having a larger width W3 than approximately 15 mm.

In operation, a user of the multi-use applicator 10 would place the crimped distal end 1010 of the compressible container 1000 within the U-shaped slots 54 formed between each pair of prongs 44. As material is extruded from the container 1000, the user may reopen the applicator 10 and fold the crimped distal end 1010 of the compressible container 1000 to facilitate delivery of the material. Typically, however, the cover 62 described herein facilitates the even extraction of materials from within the compressible container 1000 such that the user would not need to fold the crimped distal end 1010 of the compressible container 1000.

Figure 3:
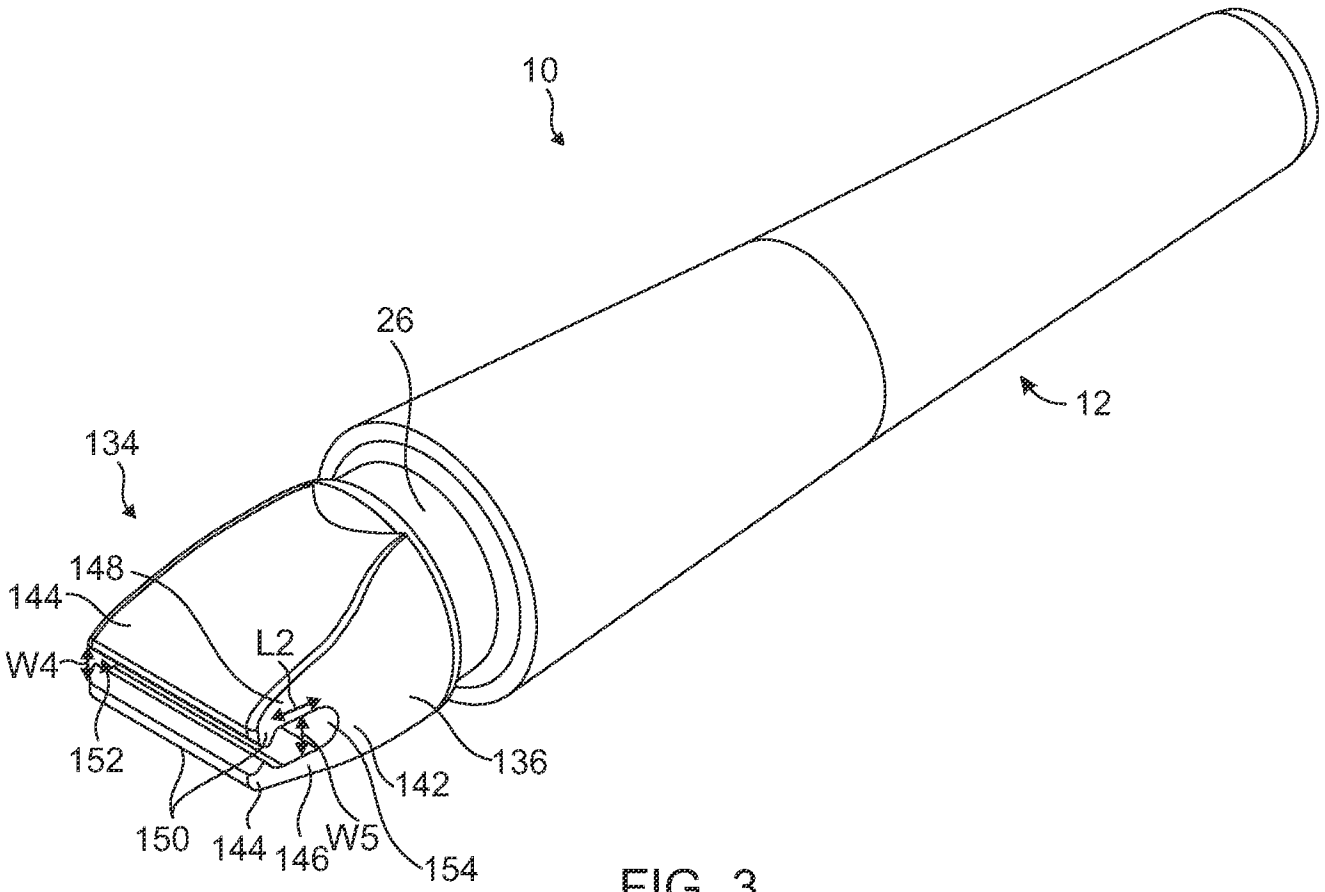
FIG. 3 is a perspective view of another embodiment of the multi-use applicator in accordance with one or more aspects of the present invention, where the fastening mechanism comprises a single pair of elongated prongs forming a U-shaped channel between them.

FIG. 3 shows an alternative embodiment of a fastening mechanism 134, where the fastening mechanism 134 comprises a single pair of elongated prongs 144, the first prong 144 would be oppositely disposed from the second prong 144. Each elongated prong 144 has an elongated distal end 146 that is coupled to the proximal end 142 of the base 136 of the fastening mechanism 134, has an elongated body 148, and has an elongated inwardly curved proximal end 150. The prongs 144 would define a U-shaped channel 154 (generically referred to as a "U-shaped space") between the body 148 of the first prong 144 and the body 148 of the second prong 144. The U-shaped channel 154 would traverse the external diameter of the base 136 of the fastening mechanism 134. The prongs 144 would also define a space 152 between the inwardly curved proximal end 150 of the first prong 144 and the inwardly curved proximal end 150 of the second prong 144. The width W4 of the space 152 between the inwardly curved proximal end 150 of the first prong 144 and the inwardly curved proximal end 150 of the second prong 144 would be narrower than the width W5 of the U-shaped channel 154 between the first prong 144 and the second prong 144. With this configuration, the crimped distal end 1010 of the compressible container 1000 may be held within the U-shaped channel 154 between the body 148 of the first prong 144 and the body 148 of the second prong 144. Furthermore, the inwardly curved proximal ends 150 of the first and second prongs 144 together would form a tight fit about the crimped distal end 1010 of the compressible container 1000 to prevent it from sliding out of the U-shaped channel 154.

The construction of this embodiment would be similar to that described above. The width W5 of the U-shaped channel 154 between the first prong 144 and the second prong 144 of the fastening mechanism 134 may vary depending upon the size of the compressible container 1000 that will be used with the multi-use applicator 10. For example, the width W5 of the U-shaped channel 154 may be within the range of approximately 2.5 mm for smaller compressible containers 1000 to approximately 4.5 mm for larger compressible containers 1000. Although this range is provided as an example, it should be clearly understood that substantial benefit may still be derived from a width W5 that is smaller than 2.5 mm or larger than 4.5 mm, as long as the width W5 of the U-shaped channel 154 is sized to accommodate the size of the compressible container 1000 intended to be used with the applicator 10. The U-shaped channel 154 may also have a length L2 of approximately 4 mm, when taken along the straight portions of the U-shaped channel 154. Although 4 mm is an example of the length L2 of the U-shaped channel 154, it should be clearly understood that substantial benefit may be derived from a length L2 longer or shorter than 4 mm, as long as the U-shaped channel 154 is long enough to accommodate the size of the compressible container 1000. Similarly, the width W4 of the space 152 between the inwardly curved proximal end 150 of the first prong 144 and the inwardly curved proximal end 150 of the second prong 144 may also vary depending upon the size of the compressible container 1000 that will be used with the multi-use applicator 10.

The diameter of the base 136 of the fastening mechanism 134 of this embodiment may also be sized to accommodate compressible containers 1000 of varying sizes. For example, a fastening mechanism 134 having a base 136 with an external diameter of approximately 15.1 mm would be suitable to couple to the crimped distal end 1010 of a compressible container 1000 wherein the crimped distal end 1010 had a width within the range of approximately 8.7 mm to approximately 15 mm. Although this range is provided as an example, it should be clearly understood that substantial benefit may still be derived from a fastening mechanism 134 having a base 136 with an external diameter that is smaller than approximately 15.1 mm to accommodate a compressible container 1000 with a crimped distal end 1010 having a smaller width than 8.7 mm. And it should be further understood that substantial benefit may still be derived from a fastening mechanism 134 having a base 136 with an external diameter that is larger than approximately 15.1 mm to accommodate a compressible container 1000 with a crimped distal end 1010 having a larger width than approximately 15 mm.

The operation of this embodiment would be similar to that described above, except that a user of the multi-use applicator 10 would place the crimped distal end 1010 of the compressible container 1000 within the U-shaped channel 154 formed between the first prong 144 and the second prong 144.

The prongs 44/144 of the fastening mechanism 34/134 may be made of flexible but sturdy material such that the first prong 44/144 and second prong 44/144 may be temporarily opened or flexed outwardly from each other in order to insert the crimped distal end 1010 of the container 1000 into the U-shaped space (i.e. the U-shaped slot 54 or U-shaped channel 154) formed between them. The user may place the crimped distal end 1010 of the container 1000 within the space 52/152 between the inwardly curved proximal end 50/150 of the first prong 44/144 and the inwardly curved proximal end 50/150 of the second prong 44/144 and push the container 1000 longitudinally toward the distal end 20 of the body 16 of the holding member 12. Once the crimped distal end 1010 of the container 1000 is received into the U-shaped slot 54 (or U-shaped channel 154), the first prong 44/144 and second prong 44/144 would then return to their original position, with the inwardly curved proximal ends 50/150 of the first and second prongs 44/144 firmly gripping the crimped distal end 1010 of the container 1000. Alternatively, the user may slide the crimped distal end 1010 of the compressible container 1000 laterally into the U-shaped space (i.e. the U-shaped slot 54 or U-shaped channel 154) between the first prong 44/144 and the second prong 44/144. In another embodiment, the prongs 44/144 may be made of non-flexible rigid material such that user may only be able to slide the crimped distal end 1010 of the compressible container 1000 laterally into the U-shaped space (i.e. the U-shaped slot 54 or U-shaped channel 154) between the first prong 44/144 and the second prong 44/144. Many types of fastening mechanisms 34/134 may be used and those illustrated above are for purposes of illustration and should not be construed as limiting.

The compressible container 1000 for which the multi-use applicator 10 may be used may include a closed crimped distal end 1010 and a dispensing outlet 1018. The dispensing outlet 1018 may typically be a narrow-reinforced section that allows materials within the container 1000 to be extruded therefrom. Various sizes of compressible containers 1000 may be used with the applicator 10. As will be shown below, the length of the cover 62 may vary depending on the size of the compressible container 1000 holding the materials. For example, smaller compressible containers 1000 such as glue containers 1000 may use a smaller cover 62, while larger containers 1000 such as toothpaste containers 1000 may need a larger cover 62.

After the compressible container 1000 having the material therein is secured within the prongs 44/144 of the fastening mechanism 34/134, a cover 62 may be placed over the compressible container 1000 and coupled to the holding member 12.

Figure 4:
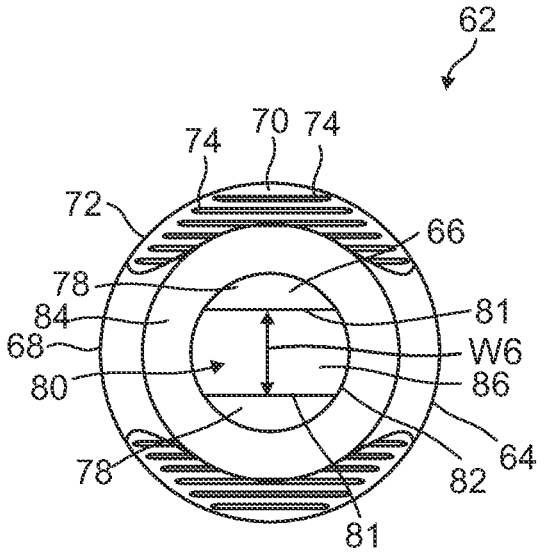
FIG. 4 is a top view of the cover of the multi-use applicator of FIG. 1.
Figure 5:
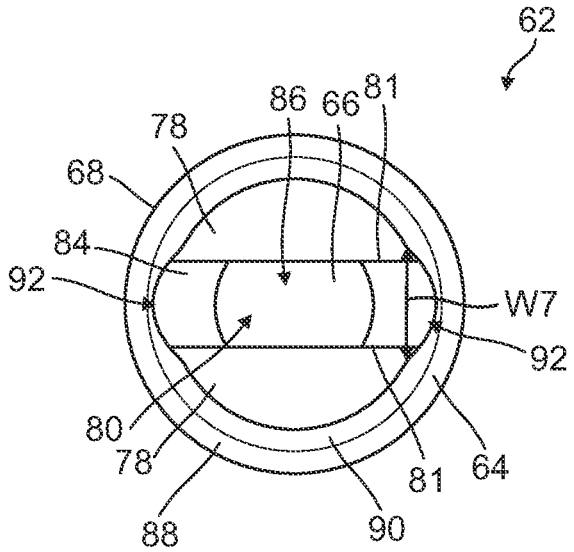
FIG. 5 is a bottom view of the cover of FIG. 4.
Figure 6:
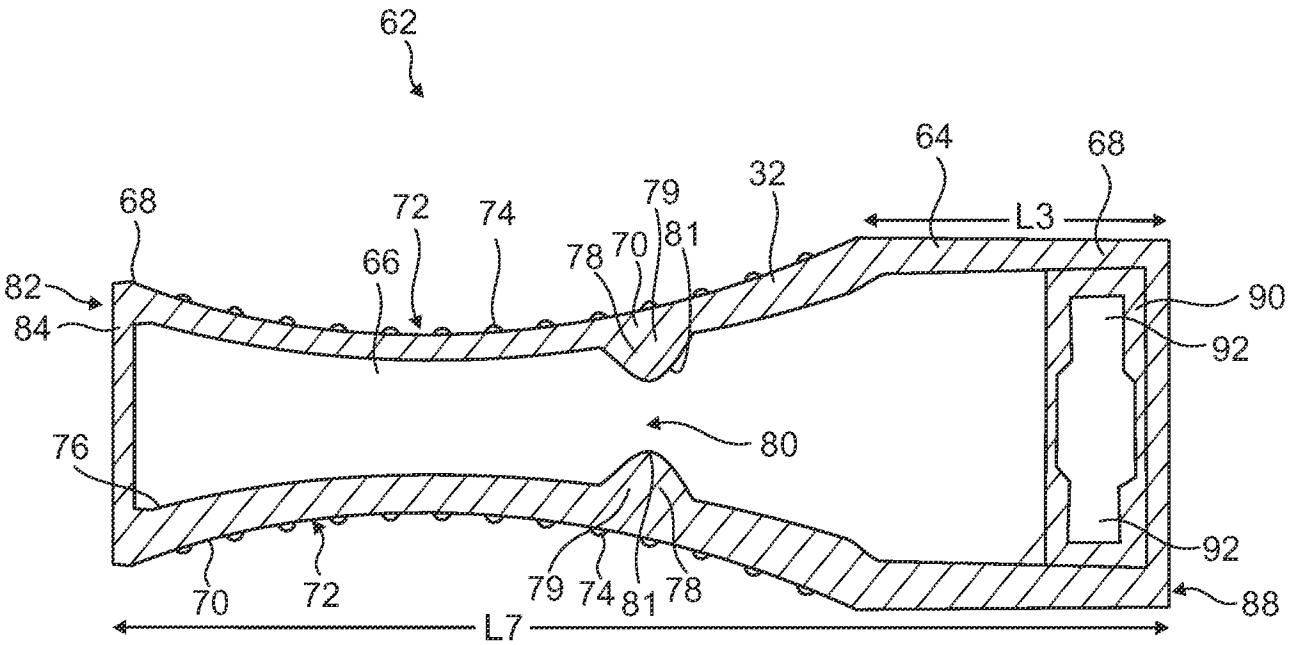
FIG. 6 is a longitudinal cross-sectional side view of the cover of the multi-use applicator of FIG. 1, taken along the line 6-6 of FIG. 1.

FIGS. 4-6 show an embodiment of the cover 62 of the multi-use applicator 10. The cover 62 may be made of pliable plastic, rubber, or any other flexible compressible material. The cover 62 will also be made of resilient material so that it will return to its original shape after compression. The cover 62 may have a substantially tubular body 64 that defines a central channel 66 formed therethrough. The central channel 66 is configured to house the compressible container 1010 within the body 64 of the cover 62 when the applicator 10 is fully assembled with a compressible container 1010 held therein. The cover 62 therefore has an open proximal end 82 and an open distal end 88. The body 64 may have a uniform external diameter along its entire length or, as shown, the body 64 of the cover 62 may be tapered such that the external diameter of the proximal end 82 of the body 64 is smaller than the external diameter of the distal end 88 of the body 64.

The cover 62 may have an annular shoulder 84 formed at the proximal end 82 of its body 64. As shown in FIG. 4, the annular shoulder 84 may be positioned perpendicularly to the outer surface 68 of the body 64 and may extend inwardly toward the central channel 66 of the body 64. The annular shoulder 84 does not completely obstruct the central channel 66 at the proximal end 82 of the body 64. Rather, the annular shoulder 84 only partially obstructs the central channel 66 at the proximal end 82 of the body 64, thereby defining an aperture 86 at the proximal end 82 of the body 64 wherein the diameter of the aperture 86 defined by the annular shoulder 84 is smaller than a diameter of the central channel 66 of the body 64 of the cover 62. The aperture 86 is configured to receive the dispensing outlet 1018 of the compressible container 1000 therethrough. The diameter of the aperture 86 defined by the annular shoulder 84 is smaller than the width of the body 1012 of the compressible container 1000, thus preventing the compressible container 1000 from inadvertently exiting the applicator 10 through the open proximal end 82 of the cover 62.

As mentioned above, the cover 62 may also have an interior annular flange 90 formed on the interior surface 76 of the body 64 and positioned at the open distal end 88 of its body 64. The interior annular flange 90 at the distal end 88 of the cover 62 is configured to mate with the connection point 56 (i.e. annular groove) of the holding member 12. As shown in FIG. 5, the interior annular flange 90 may have two notches 92 formed at opposite positions along the circumference of the interior annular flange 90. The shape and position of the two oppositely disposed notches 92 conform to the shape and position of the two oppositely disposed sets of prongs 44 of the fastening mechanism 34 of the holding member 12. In other words, the two oppositely disposed notches 92 of the interior annular flange 90 of the cover 62 slidably mate with the two oppositely disposed pairs of prongs 44 of the fastening mechanism 34 of the holding member 12. In operation, when the user wishes to couple the cover 62 to the holding member 12, the user may align each set of prongs 44 with its corresponding notch 92 and slide the prongs 44 in a proximal direction along the length of the notches 92 and into the open distal end 88 of the cover 62. The user will continue to slide the prongs 44 into the open distal end 88 of the cover 62 until the interior annular flange 90 at the distal end 88 of the cover 62 mates with the connection point 56 (i.e. annular groove) of the holding member 12. The interior annular flange 90 at the distal end 88 of the cover 62 will then be flush with the annular shoulder 58 of the holding member 12, between the neck 26 and the body 16 of the holding member 12.

The cover 62 may have at least one concave indentation 70 formed on the outer surface 68 of its body 64. In the embodiment shown, the cover 62 has two concave indentations 70 formed on its outer surface 68. The two concave indentations 70 are positioned opposite each other. These two concave indentations 70 together form a compression area 72 on the body 64 where a user would apply force with his thumb and forefinger in opposing directions. Each concave indentation 70 may have an indicator 74 formed or printed thereon. The indicator 74 will identify the two concave indentations 70 as the compression area 72 where the user will need to squeeze and apply opposing force in order to dispense product from the compressible container 1000. In the embodiment shown here, the indicator 74 on each concave indentation 70 may comprise a plurality of textured ribs formed on the outer surface of the cover 62. Although the figures herein depict the concave indentations 70 as having indicators 74 formed or printed thereon, it should be clearly understood that substantial benefit may still be derived from concave indentations 70 that do not have any indicators 74 formed or printed thereon.

When the crimped distal end 1010 of the compressible container 1000 has been secured between the prongs 44 of the fastening mechanism 34 and the cover 62 has been coupled to the holding member 12, the user may squeeze the two opposing concave indentations 70 together, causing the central channel 66 of the body 64 of the cover 62 to compress so that an interior surface 76 of the cover 62 applies opposing force onto opposing surfaces of the body 1012 of the compressible container 1000 positioned within the cover 62.

The cover 62 may also have at least two protrusions 78 formed at opposite positions on the interior surface 76 of the cover 62. Each protrusion 78 may be an elongated wedge-shaped wall having a wide base 79 coupled to the interior surface 76 of the cover 62 and having a narrow tip 81 extending inwardly toward the center of the central channel 66. As shown in FIG. 6, the protrusions 78 are positioned within the compression area 72, preferably within a distal portion 32 of the compression area 72. The protrusions 78 each traverse across a portion of the central channel 66 of the cover 62. The protrusions 78 partially obstruct the central channel 66 of the cover 62 from opposite sides, thereby creating a compression void 80 between them. Where the protrusions 78 are positioned within the distal portion 32 of the compression area 72, the compression void 80 is then also positioned within the distal portion 32 of the compression area 72. From a top view (see FIG. 4) or a bottom view (see FIG. 5) of the cover 62, the compression void 80 between the two oppositely disposed protrusions 78 appears to be substantially rectangular in shape. As particularly shown in the bottom view of FIG. 5, the compression void 80 is aligned with the two notches 92 formed along the circumference of the interior annular flange 90. Furthermore, the width W6 of the compression void 80 may be equal to the width W7 of each of the notches 92 formed along the circumference of the interior annular flange 90.

In construction, the cover 62 may vary in length depending upon the size/length of the compressible container 1000 that will be used with the multi-use applicator 10. For example, the length L3 of the cover 62, particularly the portion of the body 64 of the cover 62 between the concave indentations 70 and the open distal end 88 of the cover 62, may be within the range of approximately 13 mm for shorter compressible containers 1000 to approximately 20 mm for longer compressible containers 1000. Although this range is provided as an example, it should be clearly understood that substantial benefit may still be derived from a length L3 that is smaller than 13 mm or larger than 20 mm, as long as the length L3 of the cover 62, particularly the portion of the body 64 of the cover 62 between the concave indentations 70 and the open distal end 88 of the cover 62, is sized to accommodate the size/length of the compressible container 1000 intended to be used with the applicator 10.

In operation, the user of the multi-use applicator 10 would place the crimped distal end 1010 of the compressible container 1000 within the U-shaped slots 54 (or U-shaped channel 154) formed between each pair of prongs 44. The user will then insert the compressible container 1000 into the open distal end 88 of the cover 62. To do this, the user will align the compressible tubular container 1000 so that it will pass through the rectangular shaped compression void 80. By orienting the compressible container 1000 in this manner, this will also align each pair of prongs 44 of the fastening mechanism 34 with its corresponding notch 92 in the interior annular flange 90 on the distal end 88 of the cover 62. The user will then slide the prongs 44 lengthwise along the notches 92 and into the open distal end 88 of the cover 62 until the dispensing outlet 1018 of the compressible container 1000 exits the aperture 86 defined by the annular shoulder 84 formed at the proximal end 82 of the cover 62 and until the interior annular flange 90 of the distal end 88 of the cover 62 mates with the connection point 56 (i.e. annular groove) of the holding member 12. At this point, the interior annular flange 90 will be flush with the annular shoulder 58 between the neck 26 and the body of the holding member 12.

Figure 7:
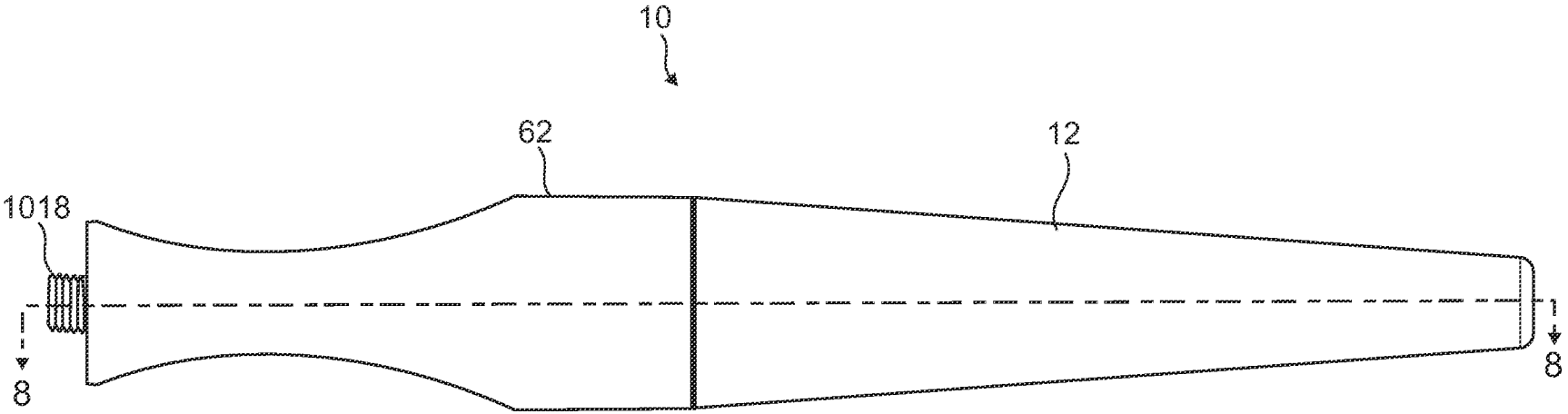
FIG. 7 is a side view of the multi-use applicator shown in a closed position, where a cover is placed over the compressible container and coupled to the holding member.

Referring to FIG. 7, when the applicator 10 is assembled and the interior annular flange 90 of the distal end 88 of the cover 62 mates with the connection point 56 (i.e. annular groove) of the holding member 12, the distal end 88 of the cover 62 will preferably have an external diameter that is equal to the external diameter of the proximal end 18 of the body 16 of the holding member 12. Although this configuration is preferred, it should be clearly understood that substantial benefit may still be derived if the distal end 88 of the cover 62 had a larger or smaller external diameter than the external diameter of the proximal end 18 of the body 16 of the holding member 12.

Figure 8:
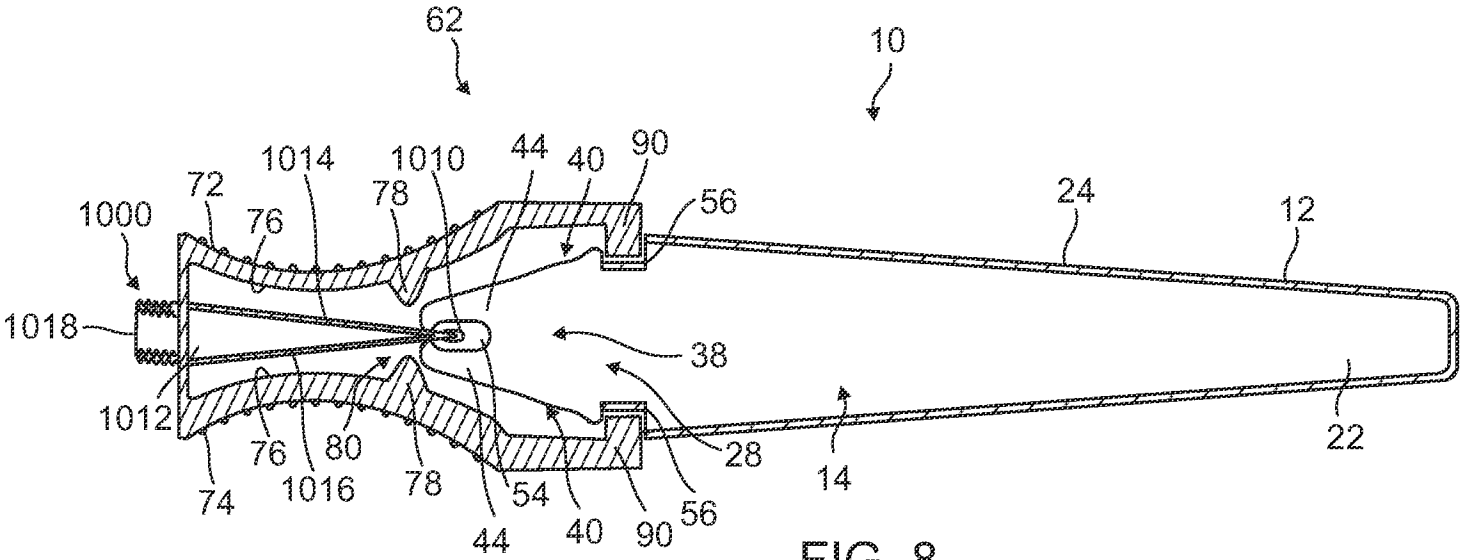
FIG. 8 is a longitudinal cross-sectional side view of the multi-use applicator of FIG. 7 taken along the line 8-8 of FIG. 7, where no force is being applied to the compression area of the cover.
Figure 9:
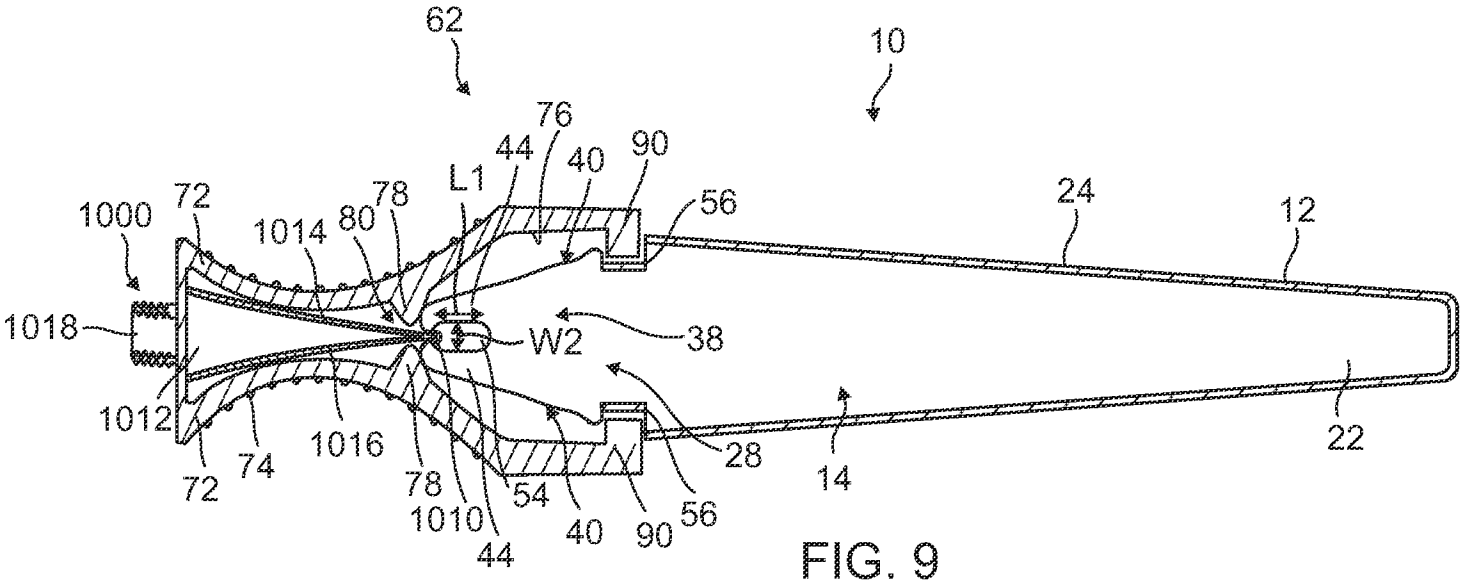
FIG. 9 is a longitudinal cross-sectional side view of the multi-use applicator of FIG. 7, shown with force being applied to the compression area of the cover.

In FIG. 8, the multi-use applicator 10 is shown in a closed and relaxed position with a compressible container 1000 therein. The applicator 10 is in a relaxed position because no force is being applied to the compression area 72 of the cover 62. The compressible container 1000 is shown as having a body 1012, a dispensing outlet 1018 at its proximal end 1020, and a crimped distal end 1010. The crimped distal end 1010 is held within the U-shaped slot 54 between the first set of prongs 44 and the U-shaped slot 54 (not shown in this side view) between the second set of prongs 44. The body 1012 of the compressible container 1000 is positioned within the cover 62 such that a distal portion of the body 1012 of the compressible container 1000, which is adjacent to the crimped distal end 1010 of the compressible container 1000, is positioned within the compression void 80 formed between the two oppositely disposed protrusions 78 on the interior surface 76 of the cover 62. In this relaxed position, the oppositely disposed protrusions 78 formed on the interior surface 76 of the cover 62 are adjacent to but do not touch the corresponding oppositely disposed surfaces 1014, 1016 of the body 1012 of the compressible container 1000.

From this side view, it can be seen that the angles of the opposing tapered surfaces 40 of the base 36 correspond to the angles of the distal portions of the opposing concave indentations 70 on the outer surface 68 of the cover 62. The opposing tapered surfaces 40 of the base 36 of the holding member 12 therefore allow for the compression area 72 of the cover 62 to be positioned surrounding the body 1012 of the compressible container 1000 when the cover 62 is coupled to the holding member 12. More importantly, the opposing tapered surfaces 40 of the base 36 of the holding member 12 allow for the distal portion of the body 1012 of the compressible container 1000 to be positioned within the compression void 80 formed between the two oppositely disposed protrusions 78 on the interior surface 76 of the cover 62 when the cover 62 is coupled to the holding member 12.

In operation, the user may use their thumb and forefinger to apply opposing force to the compression area 72. It can be seen in the side view of FIG. 9 that by applying opposing force to the compression area 72, a first elongated protrusion 78 applies inward force onto a first surface 1014 of the body 1012 of the compressible container 1000 and a second elongated protrusion 78 applies an inward force onto the opposing second surface 1016 of the body 1012 of the compressible container 1000. In this embodiment, the oppositely disposed protrusions 78 on the interior surface 76 of the cover 62 apply opposing force to a distal portion of the body 1012 of the compressible container 1000 which is adjacent to the crimped distal end 1010 of the compressible container 1000. The particular alignment of the protrusions 78 of the cover 62 relative to the distal portion of the body 1012 of the compressible container 1000 which is adjacent to the crimped distal end 1010 of the compressible container 1000 is crucial to the avoidance of uneven distribution of materials within the compressible container 1000. This particular alignment is meant to mimic the practice of "squeezing from the bottom" of a tubular compressible container 1000 (e.g. squeezing from the bottom of a toothpaste tube") so that the materials within the compressible container 1000 are only distributed toward the direction of the dispensing outlet 1018.

The cover 62 described herein may provide enhanced flow and pinpoint control for dispensing liquid or viscous fluid from the compressible tubular container 1000. Depending on the material within the compressible container 1000, different covers 62 may be provided, and the sensitivity of the materials may dictate which cover 62 may be used. For example, a less viscous material within the compressible container 1000 may require a softer cover 62 such that the user may be allowed to depress further into the compressible container 1000 to extrude the materials therefrom. Oppositely, a compressible container 1000 having a more viscous material may be paired with a cover 62 made of a stiffer material such that a tighter squeeze or press may be needed to extract the liquid materials from the compressible container 1000.

Figure 10:
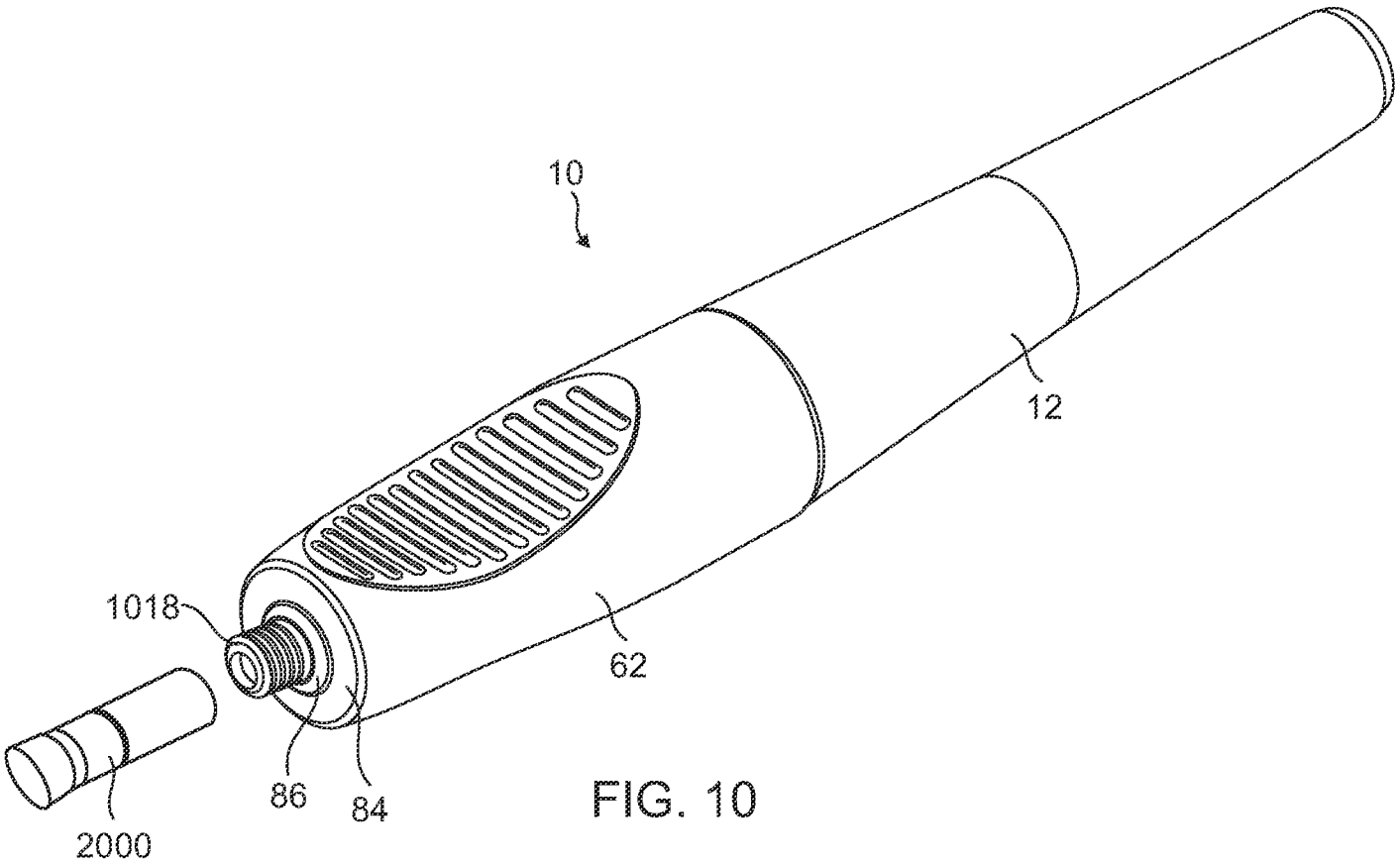
FIG. 10 is a perspective view of the multi-use applicator of FIG. 1, shown with an optional attachment coupled to the dispensing outlet of the compressible container.

The dispensing outlet 1018 of the compressible container 1000 may extend outwardly from the cover 62 through the aperture 86 defined by the annular shoulder 84 at the proximal end 82 of the cover 62. As shown in FIG. 10, an additional attachment 2000 may be provided to enhance the spread of materials coming from the compressible container 1000. After being squeezed from the body 1012 of the compressible container 1000 positioned within the cover 62, the materials within the compressible container 1000 may be expelled through its dispensing outlet 1018 and into the attachment 2000.

Different types of attachments 2000 may be used depending upon the type of application the user desires. The materials may be spread evenly or in strips. Other types of attachments 2000 may be used and is not limited to that shown above. For example, the attachment 2000 may allow a predetermined buildup of material to be made within it and when a threshold is reached, the attachment 2000 would dispel it out. As another example, a toothbrush attachment 2000 may be used. A channel allowing for toothpaste to be distributed from the compressible container 1000 may be funneled into bristles of a toothbrush. In operation, the user would simply squeeze the cover 62 to dispel toothpaste when the user is brushing their teeth.

Advantageously, the applicator 10 may be ergonomically friendly and designed to be used with varying viscosities. The unique delivery system may minimize waste by controlling the dosage. The dosage may vary based upon intended viscosity of the materials contained within the compressible container 1000. Multi-use product capability may be provided through the use of interchangeable attachments 2000 that may be made dependent upon intended use.

The dispenser for expelling compounds may be made of different materials. For example, the holding member 12 may be made of solid and less durable materials while the cover 62 may be made of software materials such as pliable plastic, rubber, or the like. This may allow for dispensing of the materials out of the container 1000 while providing a rigid holding member 12 to hold onto. Alternatively, the entirety of the dispenser may be made of the same materials.

The multi-use applicator 10 of the present invention may be made to accommodate the size and shape of various compressible containers 1000. According to one illustrative example, the total length L4 of the holding member 12, measured from the inwardly curved proximal ends 50 of the prongs 44 to the distal end 20 of the body 16, may be 87.95 mm. The length L5 of the body 16 of the holding member 12, measured from the annular shoulder 58 between the neck 26 and the body 16 to the distal end 20 of the body 16, may be 67.39 mm. And thus, the remaining length L6 of the holding member 12, measured from the inwardly curved proximal ends 50 of the prongs 44 to the annular shoulder 58 between the neck 26 and the body 16, may be 20.56 mm. In this example, the holding member 12 may have an external diameter, measured at the annular shoulder 58 between the neck 26 and the body 16, of 17.72 mm. The holding member 12 may also have an external diameter, measured at the distal end 20 of the body 16, of 9.70 mm.

According to the same illustrative example, the measurements of the cover 62 will be made to correspond with the measurements of the holding member 12. In this example, the total length L7 of the cover 62 may be 47.44 mm. Where the holding member 12 has an external diameter of 17.72 mm (measured at the annular shoulder 58 between the neck 26 and the body 16), the cover 62 will have an external diameter of 17.72 mm (measured at the distal end 88). With this configuration, the meeting point between the cover 62 and the holding member 12 will be flat and even. In this example embodiment, when the cover 62 is coupled to the holding member 12, the overall length of the applicator 10 will be 114.83 mm (47.44 mm cover 62 length at L7+67.39 mm length of holding member 12 at L5).

The foregoing description is illustrative of particular embodiments of the application, but it is not meant to be limitation upon the practice thereof. While embodiments of the disclosure have been described in terms of various specific embodiments, those skilled in the art will recognize that the embodiments of the disclosure may be practiced with modifications within the spirit and scope of the claims.

What is claimed is:

1. An applicator for use with a compressible container, the applicator comprising:

a holding member comprising:

a body;

a neck extending from a proximal end of the body of the holding member; and a fastening mechanism extending from a proximal end of the neck of the holding member, the fastening mechanism being configured to removably couple to the compressible container, and the fastening mechanism comprising:

a base:

at least two oppositely disposed prongs, each prong comprising:

a distal end extending from the base of the fastening mechanism;

a body; and an inwardly curved proximal end; and a U-shaped space formed between the at least two oppositely disposed prongs, wherein the U-shaped space is configured to receive and hold a distal end of the compressible container; and a cover removably coupled to the holding member, the cover comprising:

a body defining a central channel therethrough;

a compression area on the body of the cover; and at least two oppositely disposed protrusions formed on an interior surface of the body of the cover and positioned within the compression area.

2. The applicator of claim 1 wherein the holding member further comprises a connection point, the connection point being an annular groove comprising:

a first annular shoulder formed between the neck of the holding member and the body of the holding member;

the neck of the holding member; and a second annular shoulder formed between the neck and the fastening mechanism.

3. The applicator of claim 1 wherein the fastening mechanism further comprises a space formed between the inwardly curved proximal end of a first prong and the inwardly curved proximal end of a second prong, wherein a width of the space between the inwardly curved proximal end of the first prong and the inwardly curved proximal end of the second prong is narrower than a width of the U-shaped space between the first prong and the second prong.

4. The applicator of claim 1 wherein the at least two oppositely disposed prongs of the fastening mechanism comprises:

two oppositely disposed elongated prongs, each elongated prong comprising:

an elongated distal end extending from the base of the fastening mechanism;

an elongated body; and an elongated inwardly curved proximal end;

wherein the U-shaped space is a U-shaped channel formed between the two oppositely disposed elongated prongs.

5. The applicator of claim 1 wherein the at least two oppositely disposed prongs of the fastening mechanism comprises:

a first pair of oppositely disposed prongs; and a second pair of oppositely disposed prongs positioned parallel to the first pair of oppositely disposed prongs;

wherein a V-shaped space is formed between the first pair of oppositely disposed prongs and the second pair of oppositely disposed prongs;

wherein a first U-shaped space is formed between the two prongs of the first pair of oppositely disposed prongs; and wherein a second U-shaped space is formed between the two prongs of the second pair of oppositely disposed prongs and is positioned directly in line with the first U-shaped space.

6. The applicator of claim 1 wherein the fastening mechanism further comprises two oppositely disposed tapered surfaces formed on a distal portion of the base.

7. The applicator of claim 1 wherein the cover further comprises:

an annular shoulder formed at a proximal end of the body of the cover, the annular shoulder being positioned perpendicularly to an outer surface of the body of the cover and extending inwardly toward the central channel of the body of the cover; and an aperture defined by the annular shoulder of the body of the cover, the aperture for receiving a dispensing outlet of the compressible container therethrough;

wherein a diameter of the aperture is smaller than a diameter of the central channel of the body of the cover.

8. The applicator of claim 1 wherein the cover further comprises an interior annular flange formed on the interior surface of the body of the cover and positioned at an open distal end of the body of the cover.

9. The applicator of claim 1 wherein each of the at least two oppositely disposed protrusions formed on the interior surface of the body of the cover is a wall having:

a base coupled to the interior surface of the cover; and a tip extending inwardly toward a center of the central channel of the cover;

wherein each of the at least two protrusions traverses across a portion of the central channel of the cover creating a compression void between the at least two protrusions.

10. The applicator of claim 1 wherein the at least two oppositely disposed protrusions formed on the interior surface of the body of the cover are positioned within a distal portion of the compression area.

11. The applicator of claim 1 wherein the compression area is formed by two oppositely disposed concave indentations formed on an outer surface of the body of the cover.

12. The applicator of claim 11 wherein at least one of the two concave indentations further comprises an indicator formed thereon.

13. The applicator of claim 12 wherein the indicator is a plurality of textured ribs.

14. A multi-use applicator for use with a compressible container, the applicator comprising:

a holding member comprising:

a conical body;

a cylindrical neck extending from a proximal end of the conical body of the holding member; and a fastening mechanism extending from a proximal end of the cylindrical neck of the holding member, the fastening mechanism comprising:

a cylindrical base;

at least two oppositely disposed prongs, each prong comprising:

a distal end extending from the cylindrical base of the fastening mechanism;

a body; and an inwardly curved proximal end;

a U-shaped space formed between the at least two oppositely disposed prongs, wherein the U-shaped space is configured to receive and hold a crimped distal end of the compressible container;

a space formed between the inwardly curved proximal ends of the at least two oppositely disposed prongs, wherein a width of the space between the inwardly curved proximal ends of the at least two oppositely disposed prongs is narrower than a width of the U-shaped space between the at least two oppositely disposed prongs; and two oppositely disposed tapered surfaces formed on a distal portion of the cylindrical base;

a first annular shoulder formed between the cylindrical neck of the holding member and the conical body of the holding member; and a second annular shoulder formed between the cylindrical neck of the holding member and the cylindrical base of the fastening mechanism;

wherein the first annular shoulder formed between the cylindrical neck of the holding member and the conical body of the holding member, the cylindrical neck, and the second annular shoulder formed between the cylindrical neck of the holding member and the cylindrical base of the fastening mechanism together form an annular groove; and a cover removably coupled to the holding member, the cover comprising:

a flexible body defining a central channel therethrough;

a compression area on the flexible body of the cover, the compression area formed by two oppositely disposed concave indentations formed on an outer surface of the flexible body of the cover; and at least two oppositely disposed protrusions formed on an interior surface of the flexible body of the cover and positioned within a distal portion of the compression area.

15. The applicator of claim 14 wherein the at least two oppositely disposed prongs of the fastening mechanism comprises:

a first pair of oppositely disposed prongs; and a second pair of oppositely disposed prongs positioned parallel to the first pair of oppositely disposed prongs;

wherein a V-shaped space is formed between the first pair of oppositely disposed prongs and the second pair of oppositely disposed prongs;

wherein a first U-shaped space is formed between the two prongs of the first pair of oppositely disposed prongs; and wherein a second U-shaped space is formed between the two prongs of the second pair of oppositely disposed prongs and is positioned directly in line with the first U-shaped space.

16. The applicator of claim 15 wherein the cover further comprises:

an interior annular flange formed on the interior surface of the flexible body of the cover and positioned at an open distal end of the flexible body of the cover, the interior annular flange configured to mate with the annular groove of the holding member;

an annular shoulder formed at a proximal end of the flexible body of the cover, the annular shoulder being positioned perpendicularly to the outer surface of the flexible body of the cover and extending inwardly toward the central channel of the flexible body of the cover; and an aperture defined by the annular shoulder of the flexible body of the cover, the aperture for receiving a dispensing outlet of the compressible container therethrough;

wherein a diameter of the aperture is smaller than a diameter of the central channel of the flexible body of the cover.

17. The applicator of claim 16 wherein the cover further comprises:

a first notch formed within the interior annular flange formed on the interior surface of the flexible body of the cover; and a second notch formed within the interior annular flange formed on the interior surface of the flexible body of the cover and positioned opposite from the first notch;

wherein the first notch is configured to slidably mate with the first pair of oppositely disposed prongs of the fastening mechanism; and wherein the second notch is configured to slidably mate with the second pair of oppositely disposed prongs of the fastening mechanism.

18. The applicator of claim 14 wherein each of the at least two oppositely disposed protrusions formed on the interior surface of the flexible body of the cover is a wedge-shaped wall having:

a wide base coupled to the interior surface of the flexible body of the cover; and a narrow tip extending inwardly toward a center of the central channel of the cover;

wherein each of the at least two protrusions traverses across a portion of the central channel of the cover creating a compression void between the at least two oppositely disposed protrusions.

19. A multi-use applicator for use with a compressible container, the applicator comprising:

a holding member comprising:

a conical body;

a cylindrical neck extending from a proximal end of the conical body of the holding member; and a fastening mechanism extending from a proximal end of the cylindrical neck of the holding member, the fastening mechanism comprising:

a cylindrical base;

a first pair of oppositely disposed prongs;

a second pair of oppositely disposed prongs positioned parallel to the first pair of oppositely disposed prongs, wherein each prong of the first pair and second pair of prongs comprises:

a distal end extending from the cylindrical base of the fastening mechanism;

a body; and an inwardly curved proximal end;

a V-shaped space formed between the first pair of oppositely disposed prongs and the second pair of oppositely disposed prongs;

a first U-shaped slot formed between the two prongs of the first pair of oppositely disposed prongs;

a second U-shaped slot formed between the two prongs of the second pair of oppositely disposed prongs and positioned directly in line with the first U-shaped slot, wherein the first U-shaped slot and the second U-shaped slot are configured to receive and hold a crimped distal end of the compressible container;

a first space formed between the inwardly curved proximal ends of the two prongs of the first pair of oppositely disposed prongs;

a second space formed between the inwardly curved proximal ends of the two prongs of the second pair of oppositely disposed prongs, wherein a width of the first space is equal to a width of the second space and wherein the width of the first space and the width of the second space are both narrower than a width of the first U-shaped slot and a width of the second U-shaped slot; and two oppositely disposed tapered surfaces formed on a distal portion of the cylindrical base;

a first annular shoulder formed between the cylindrical neck of the holding member and the conical body of the holding member; and a second annular shoulder formed between the cylindrical neck of the holding member and the cylindrical base of the fastening mechanism, wherein the first annular shoulder formed between the cylindrical neck of the holding member and the conical body of the holding member, the cylindrical neck, and the second annular shoulder formed between the cylindrical neck of the holding member and the cylindrical base of the fastening mechanism together form an annular groove; and a cover removably coupled to the holding member, the cover comprising:

a flexible body defining a central channel therethrough;

a compression area on the flexible body of the cover, the compression area formed by two oppositely disposed concave indentations formed on an outer surface of the flexible body of the cover;

two oppositely disposed wedge-shaped protrusions formed on an interior surface of the flexible body of the cover and positioned within a distal portion of the compression area, wherein each of two protrusions traverses across a portion of the central channel of the cover creating a compression void between the two oppositely disposed protrusions;

an interior annular flange formed on the interior surface of the flexible body of the cover and positioned at an open distal end of the flexible body of the cover, the interior annular flange configured to mate with the annular groove of the holding member;

an annular shoulder formed at a proximal end of the flexible body of the cover, the annular shoulder being positioned perpendicularly to the outer surface of the flexible body of the cover and extending inwardly toward the central channel of the flexible body of the cover;

an aperture defined by the annular shoulder of the flexible body of the cover, the aperture for receiving a dispensing outlet of the compressible container therethrough, wherein a diameter of the aperture is smaller than a diameter of the central channel of the flexible body of the cover;

a first notch formed within the interior annular flange formed on the interior surface of the flexible body of the cover; and a second notch formed within the interior annular flange formed on the interior surface of the flexible body of the cover and positioned opposite from the first notch, wherein the first notch is configured to slidably mate with the first pair of oppositely disposed prongs of the fastening mechanism and wherein the second notch is configured to slidably mate with the second pair of oppositely disposed prongs of the fastening mechanism.

20. An applicator for use with a compressible container, the applicator comprising:

a holding member comprising:

a body;

a neck extending from a proximal end of the body of the holding member; and a fastening mechanism extending from a proximal end of the neck of the holding member, the fastening mechanism being configured to removably couple to the compressible container; and a cover removably coupled to the holding member, the cover comprising:

a body defining a central channel therethrough;

a compression area on the body of the cover; and at least two oppositely disposed protrusions formed on an interior surface of the body of the cover and positioned within the compression area, wherein each of the at least two oppositely disposed protrusions is a wall having:

a base coupled to the interior surface of the cover; and a tip extending inwardly toward a center of the central channel of the cover;

wherein each of the at least two protrusions traverses across a portion of the central channel of the cover creating a compression void between the at least two protrusions.

21. The applicator of claim 20 wherein the fastening mechanism of the holding member comprises:

a base;

at least two oppositely disposed prongs, each prong comprising:

a distal end extending from the base of the fastening mechanism;

a body; and an inwardly curved proximal end; and a U-shaped space formed between the at least two oppositely disposed prongs, wherein the U-shaped space is configured to receive and hold a distal end of the compressible container.

22. The applicator of claim 21 wherein the at least two oppositely disposed prongs of the fastening mechanism comprises:

two oppositely disposed elongated prongs, each elongated prong comprising:

an elongated distal end extending from the base of the fastening mechanism;

an elongated body; and an elongated inwardly curved proximal end;

wherein the U-shaped space is a U-shaped channel formed between the two oppositely disposed elongated prongs.

23. The applicator of claim 21 wherein the at least two oppositely disposed prongs of the fastening mechanism comprises:

a first pair of oppositely disposed prongs; and a second pair of oppositely disposed prongs positioned parallel to the first pair of oppositely disposed prongs;

wherein a V-shaped space is formed between the first pair of oppositely disposed prongs and the second pair of oppositely disposed prongs;

wherein a first U-shaped space is formed between the two prongs of the first pair of oppositely disposed prongs; and wherein a second U-shaped space is formed between the two prongs of the second pair of oppositely disposed prongs and is positioned directly in line with the first U-shaped space.

24. The applicator of claim 20 wherein the at least two oppositely disposed protrusions formed on the interior surface of the body of the cover are positioned within a distal portion of the compression area.

25. An applicator for use with a compressible container, the applicator comprising:

a holding member comprising:

a body;

a neck extending from a proximal end of the body of the holding member; and a fastening mechanism extending from a proximal end of the neck of the holding member, the fastening mechanism being configured to removably couple to the compressible container; and a cover removably coupled to the holding member, the cover comprising:

a body defining a central channel therethrough;

a compression area on the body of the cover, wherein the compression area is formed by two oppositely disposed concave indentations formed on an outer surface of the body of the cover; and at least two oppositely disposed protrusions formed on an interior surface of the body of the cover and positioned within the compression area.

26. The applicator of claim 25 wherein the fastening mechanism of the holding member comprises:

a base;

at least two oppositely disposed prongs, each prong comprising:

a distal end extending from the base of the fastening mechanism;

a body; and an inwardly curved proximal end;

a U-shaped space formed between the at least two oppositely disposed prongs, wherein the U-shaped space is configured to receive and hold a distal end of the compressible container.

27. The applicator of claim 26 wherein the at least two oppositely disposed prongs of the fastening mechanism comprises:

two oppositely disposed elongated prongs, each elongated prong comprising:

an elongated distal end extending from the base of the fastening mechanism;

an elongated body; and an elongated inwardly curved proximal end;

wherein the U-shaped space is a U-shaped channel formed between the two oppositely disposed elongated prongs.

28. The applicator of claim 26 wherein the at least two oppositely disposed prongs of the fastening mechanism comprises:

a first pair of oppositely disposed prongs; and a second pair of oppositely disposed prongs positioned parallel to the first pair of oppositely disposed prongs;

wherein a V-shaped space is formed between the first pair of oppositely disposed prongs and the second pair of oppositely disposed prongs;

wherein a first U-shaped space is formed between the two prongs of the first pair of oppositely disposed prongs; and wherein a second U-shaped space is formed between the two prongs of the second pair of oppositely disposed prongs and is positioned directly in line with the first U-shaped space.

29. The applicator of claim 25 wherein the at least two oppositely disposed protrusions formed on the interior surface of the body of the cover are positioned within a distal portion of the compression area.

30. An applicator for use with a compressible container, the applicator comprising:

a holding member comprising:

a body;

a neck extending from a proximal end of the body of the holding member; and a fastening mechanism extending from a proximal end of the neck of the holding member, the fastening mechanism being configured to removably couple to the compressible container; and a cover removably coupled to the holding member, the cover comprising:

a body defining a central channel therethrough;

a compression area on the body of the cover;

at least two oppositely disposed protrusions formed on an interior surface of the body of the cover and positioned within the compression area;

an annular shoulder formed at a proximal end of the body of the cover, the annular shoulder being positioned perpendicularly to an outer surface of the body of the cover and extending inwardly toward the central channel of the body of the cover; and an aperture defined by the annular shoulder of the body of the cover, the aperture for receiving a dispensing outlet of the compressible container therethrough;

wherein a diameter of the aperture is smaller than a diameter of the central channel of the body of the cover.

31. An applicator for use with a compressible container, the applicator comprising:

a holding member comprising:

a body;

a neck extending from a proximal end of the body of the holding member; and a fastening mechanism extending from a proximal end of the neck of the holding member, the fastening mechanism being configured to removably couple to the compressible container; and a cover removably coupled to the holding member, the cover comprising:

a body defining a central channel therethrough;

a compression area on the body of the cover;

at least two oppositely disposed protrusions formed on an interior surface of the body of the cover and positioned within the compression area; and an interior annular flange formed on the interior surface of the body of the cover and positioned at an open distal end of the body of the cover.

* * * * *